US006105220A

United States Patent [19]

Bélanger

[11] Patent Number: 6,105,220

[45] Date of Patent: Aug. 22, 2000

[54] STRUCTURE FOR A CASKET SHELL

[75] Inventor: Herman Bélanger, Saint-Juste-du-Lac, Canada

[73] Assignee: Cercueils Alliance Caskets Inc., Edmundston, Canada

[21] Appl. No.: 09/247,916

[22] Filed: Feb. 11, 1999

[51] Int. Cl.[7] ..... A61G 17/00

[52] U.S. Cl. ..... 27/4; 27/19

[58] Field of Search ..... 27/2, 4, 19; 220/4.28, 220/6, 441; 229/939

[56] References Cited

U.S. PATENT DOCUMENTS

| | | |
|---|---|---|
| 3,220,080 | 11/1965 | Connelly . |
| 3,574,906 | 4/1971 | Rittenhouse . |
| 3,729,786 | 5/1973 | Walding . |
| 4,063,337 | 12/1977 | Havey, III . |
| 4,151,630 | 5/1979 | Havey . |
| 4,156,956 | 6/1979 | Partridge et al. . |
| 4,170,054 | 10/1979 | Ruffner et al. . |
| 4,176,431 | 12/1979 | Havey, III . |
| 4,209,880 | 7/1980 | Lidholm . |
| 4,399,596 | 8/1983 | Parlour et al. . |
| 4,730,370 | 3/1988 | Elder . |
| 4,854,018 | 8/1989 | Von Bratt . |
| 4,891,869 | 1/1990 | Nutting . |
| 4,967,455 | 11/1990 | Elder . |
| 5,035,032 | 7/1991 | Nutting . |
| 5,111,559 | 5/1992 | Mohr et al. . |
| 5,307,545 | 5/1994 | Stoltz . |
| 5,353,484 | 10/1994 | Woedl et al. . |
| 5,454,141 | 10/1995 | Ozbun et al. . |
| 5,586,679 | 12/1996 | Thomas . |
| 5,740,592 | 4/1998 | Lau . |
| 5,771,548 | 6/1998 | Jenkins . |
| 5,771,549 | 6/1998 | Saaf ..... 27/4 |
| 5,815,898 | 10/1998 | Jenkins ..... 27/4 |

FOREIGN PATENT DOCUMENTS

| | | |
|---|---|---|
| 2150134 | 4/1995 | Canada . |
| 2154009 | 1/1997 | Canada . |
| 2155723 | 2/1997 | Canada . |

*Primary Examiner*—Terry Lee Melius
*Assistant Examiner*—William L. Miller
*Attorney, Agent, or Firm*—Mario D. Theriault

[57] ABSTRACT

A casket shell made of a corrugated paperboard. The shell is made of a triple-ply inner layer and a single-ply outer layer laminated over the inner layer. The corrugation in the side members of both layers are aligned vertically for maximum vertical tensile strength. The corrugation in the vertical corners in the inner layer are oriented horizontally for maximum stiffness and shape retention properties. The casket shell has a uniform thickness throughout the sides, ends and bottom thereof, and square corners to simulate the appearance of a wood structure. Each end has a vertical median slot therein for inserting the edges of a decorative covering fabric material. Both sides are prestressed to maintain a straight alignment.

15 Claims, 5 Drawing Sheets

STRUCTURE FOR A CASKET SHELL

FIELD OF THE INVENTION

The present invention relates to casket shells made of corrugated paperboard materials. More particularly, the present invention relates to paperboard casket shells that have a structural strength and a stiffness comparable to the properties of wood.

BACKGROUND OF THE INVENTION

Paperboard caskets are used for their relatively low cost of manufacture and for their inflammability properties when used for cremation. Although a large market exists for such caskets, the corrugated board structure thereof must be made to look and perform like wood in order for the casket to enjoy a market acceptance.

A number of paperboard caskets has been developed in the past and has been used with varying degrees of success. In that respect, examples of paperboard casket shells are illustrated in the following documents. In these examples, the casket shells are made of corrugated paperboard folded from blanks. In many cases, the corrugated paperboard is reinforced with wood strips at stress concentration areas. These are the types of caskets, generally, that are of interest herein. These examples are as follows:

U.S. Pat. No. 3,220,080 issued on Nov. 30, 1965 to R. E. Connelly;

U.S. Pat. No. 3,574,906 issued on Apr. 13, 1971 to R. Rittenhouse;

U.S. Pat. No. 3,729,786 issued on May 1, 1973 to R. T. Walding;

U.S. Pat. No. 4,063,337 issued on Dec. 20, 1977 to A. S. Havey III;

U.S. Pat. No. 4,151,630 issued on May 1, 1979 to A. S. Havey;

U.S. Pat. No. 4,156,956 issued on Jun. 5, 1979 to R. J. Partridge et al.;

U.S. Pat. No. 4,170,054 issued on Oct. 9, 1979 to A. Ruffner et al.;

U.S. Pat. No. 4,176,431 issued on Dec. 4, 1979 to A. S. Havey III;

U.S. Pat. No. 4,209,880 issued on Jul. 1, 1980 to S. O. Lidholm;

U.S. Pat. No. 4,399,596 issued on Aug. 23, 1983 to H. W. Parlour et al.;

U.S. Pat. No. 4,730,370 issued on Mar. 15, 1988 to B. E. Elder;

U.S. Pat. No. 4,854,018 issued on Aug. 8, 1989 to M. G. Von Bratt;

U.S. Pat. No. 4,891,869 issued on Jan. 9, 1990 to D. W. Nutting;

U.S. Pat. No. 4,967,455 issued on Nov. 6, 1990 to B. E. Elder;

U.S. Pat. No. 5,035,032 issued on Jul. 30, 1991 to D. W. Nutting;

U.S. Pat. No. 5,111,559 issued on May 12, 1992 to J. G. Mohr et al.;

U.S. Pat. No. 5,307,545 issued on May 3, 1994 to D. J. Stoltz;

U.S. Pat. No. 5,353,484 issued on Oct. 11, 1994 to S. D. Woedl et al.;

U.S. Pat. No. 5,454,141 issued on Oct. 3, 1995 to L. D. Ozbun et al.;

U.S. Pat. No. 5,586,679 issued on Dec. 24, 1996 to B. M. Thomas;

U.S. Pat. No. 5,740,592 issued on Apr. 21, 1998 to C. K. Lau;

U.S. Pat. No. 5,771,548 issued on Jun. 30, 1998 to K. T. Jenkins;

Canadian applications for patent:

CA 2,150,134 filed on Sep. 6, 1994 by A. Gillard et al.;

CA 2,154,009 filed on Jul. 17, 1995 by Y. Beauregard;

CA 2,155,723 filed on Aug. 9, 1995 by G. Huot.

It is believed that aside from general appearance, selling price and ultimate tensile strength, a first requirement by the funeral industry regarding paperboard caskets is that a casket shell must be relatively stiff to resist to some degrees, torsional stresses when lifted unevenly. A second preferred requirement by the funeral industry is believed to be that the corners of the casket shell must retain their squareness under dynamic stresses. Similarly, it is believed that a third preferred requirement by the funeral industry is that the shape of the casket shell must remain firm after several liftings and manipulations under design loading conditions. Finally, several other preferred requirements by the funeral industry are believed to be that all corners and edges of a paperboard casket shell must be sharp to better imitate a wood structure; that the side and end walls of the casket shell should have a same and uniform thickness; that a decorative material covering the shell should be joined along a vertical median line on one or both ends of the casket shell to better imitate a sewn scam in a single piece of fabric.

The paperboard caskets of the prior art are believed to be deficient at least one of the above preferred requirements, and it is this reason basically that has contributed to the development of a market demand for a better paperboard casket shell capable of resisting severe loading conditions and to better imitate a high quality wood structure.

SUMMARY OF THE INVENTION

In the present invention, however, there is provided a paperboard casket shell that has a good tensile strength, torsional strength, sharp and stiff corners, uniform thickness, and means for attaching a fabric cover along medians on the end portions thereof.

Broadly, in accordance with one feature of the invention, there is provided a casket shell having a bottom, sides and ends, and orthogonal length, width and depth dimensions. The casket shell is made of an inner layer of corrugated paperboard having a first uniform thickness, a bottom planar portion and side and end portions joining the bottom planar portion along lengthwise and widthwise creases formed in the inner layer. Each of the side portions has a longitudinal measure defined between a pair of first spaced-apart transversal edges. Each of the end portions has a U-shaped configuration comprising a planar end member set at right angle relative to and between the side portions, and two flap members each being connected to a respective side of the planar end member along a depthwise crease. Each of the flap members has a second straight edge at a distance from the depth-wise crease. Each flap member extends toward one of the side portions in a planar relationship with that side portion and with the second straight edge contiguously abutting against one of the first straight edge of the side portion.

The casket shell also has an outer layer made of paperboard material having a second uniform thickness, and a bottom segment, and planar side and planar end segments respectively overlapping the bottom portion and the side and end portions entirely, and being secure by adhesive to the inner layer for joining the flap members to the side portions.

A first advantage of the structure of the casket shell according to the present invention is that a total thickness of the superimposed inner and outer layers along the bottom, sides and ends of the casket shell is a same thickness all around for better imitating a wood structure.

In accordance with another feature of the present invention, a corrugation in the side portions is oriented along the depth dimension, and corrugation in the planar end members and in the flap members is oriented along the width and length of the casket shell respectively. Therefore a casket made with the casket shell of the present invention has relatively high tensile strength along the side portions thereof for resisting vertical forces applied to the handles of the casket, and its vertical corners have relatively maximum stiffness for resisting torsional stresses. In that respect, it has been found that an empty casket shell of the present invention, having a triple-ply inner layer, remains considerably stiff and straight when a single corner thereof is raised from a supporting surface. It has been found that the manipulation of this casket is simulative of the handling of a plywood structure.

In other features of the present invention, the outer layer has one ply and each of the end segments has a slot in a median area thereof along the depth-wise dimension for receiving and joining the edges of a flexible casket covering material. The joint formed thereby is simulative of a sewn seam in a large piece of fabric. Furthermore, the outer layer has straight-cut edges along the depth-wise corner creases of the inner layer, for better covering the corner creases and simulating the square edges in a wood structure.

According to another feature of the present invention there is provided a new method for manufacturing a casket shell made of paperboard material. The method comprises the steps of:

a) cutting and creasing a first and second paperboard blanks;
b) spraying glue over the second paperboard blank;
c) laying the first paperboard blank over the glued surface of the second blank;
d) simultaneously forming the first and second paperboard blanks into a box-like casket-shell base;
e) inserting the casket-shell base into a mold having shape and dimensions of a casket shell;
f) maintaining the casket-shell base inside the mold for a period of time of about 3 minutes;
g) removing the casket-shell base from the mold;
h) stressing the sides of the casket-shell base and holding sides in a stressed mode for a period of about 10 minutes; and
i) relieving the sides and allowing the glue to cure for about another two hours.

A notable advantage of this method is that the first and second blanks are bondable to each other in a pre-stressed mode for imparting to the casket shell a durable form with straight sides. The casket shell formed thereby has the appearance of solid wood, and the sides thereof do not bow out of shape after an initial manipulation. The paperboard casket of the present invention can be equipped with hinges and latches as those commonly used on wood caskets, and those hinges or latches remain in alignment under normal use.

According to a most important feature of the present invention, the casket shell of the present invention is believed to simultaneously satisfy all the preferred requirements by the funeral industry for a high quality paperboard casket. The casket shell of the present invention has stiff corners, stiff and strong sides, overall uniform thickness, square edges and corners, and seams along vertical medians on both ends.

Still other features of the invention is that it is susceptible of a low cost of manufacture with regard to materials, equipment and labor, and which accordingly is then susceptible of low price of sale to the funeral industry, thereby making such casket economically available to the public.

BRIEF DESCRIPTION OF THE DRAWINGS

One embodiment of this invention is illustrated in the accompanying drawings, in which like numerals denote like parts throughout the several views, and in which.

DETAILED DESCRIPTION OF THE PREFERRED EMBODIMENT

Figure 1:
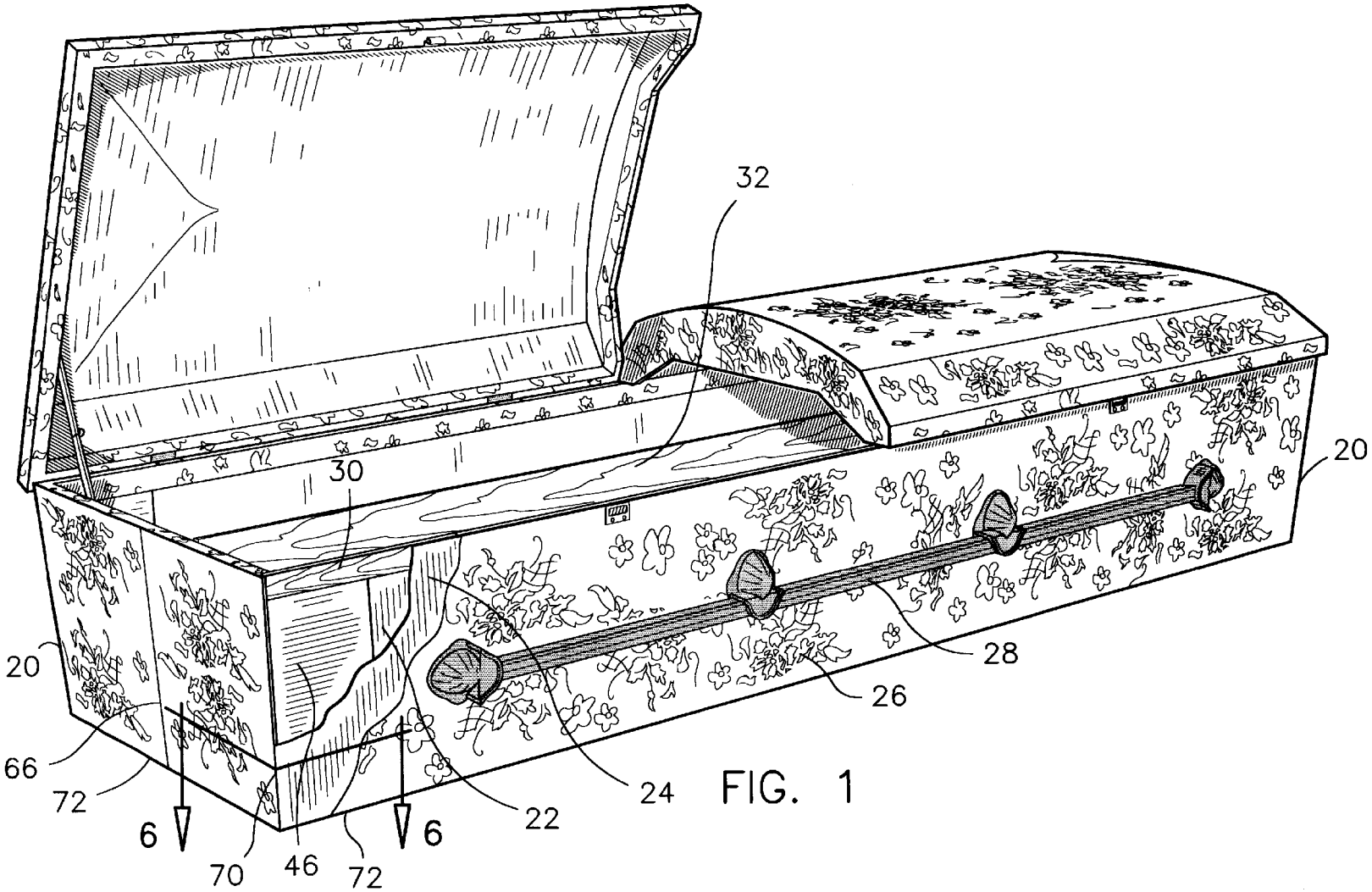
FIG. 1 is a side and end perspective view of a casket having a casket shell according to the preferred embodiment of the present invention.

While this invention is susceptible of embodiments in many various forms, there is shown in the drawings and will be described in details herein a specific embodiment, with the understanding that the present disclosure is to be considered as an example of the principles of the invention and is not intended to limit the invention to the embodiment illustrated.

Figure 2:
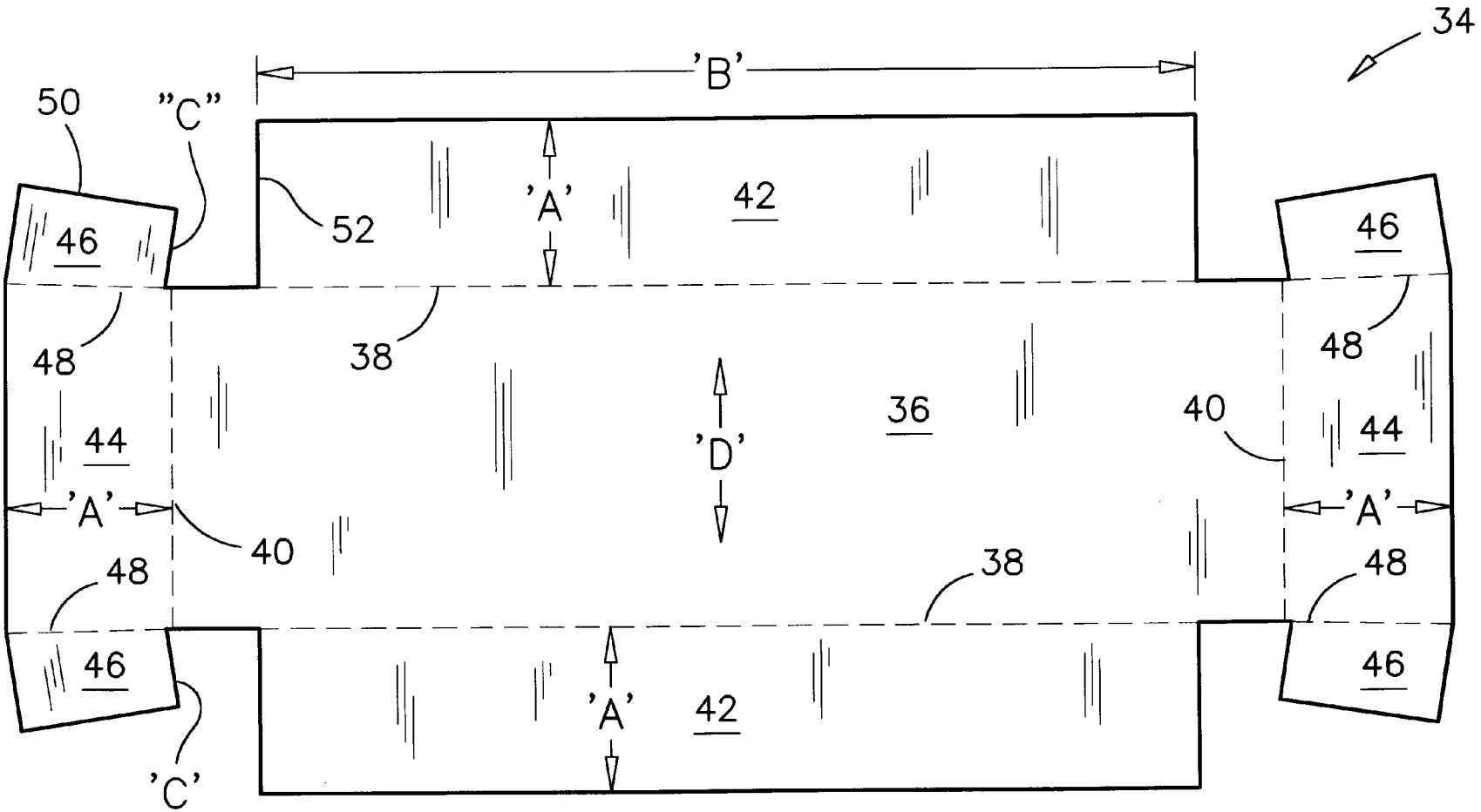
FIG. 2 is a flat pattern of an inner layer of corrugated paperboard used in the structure of the casket shell.
Figure 3:
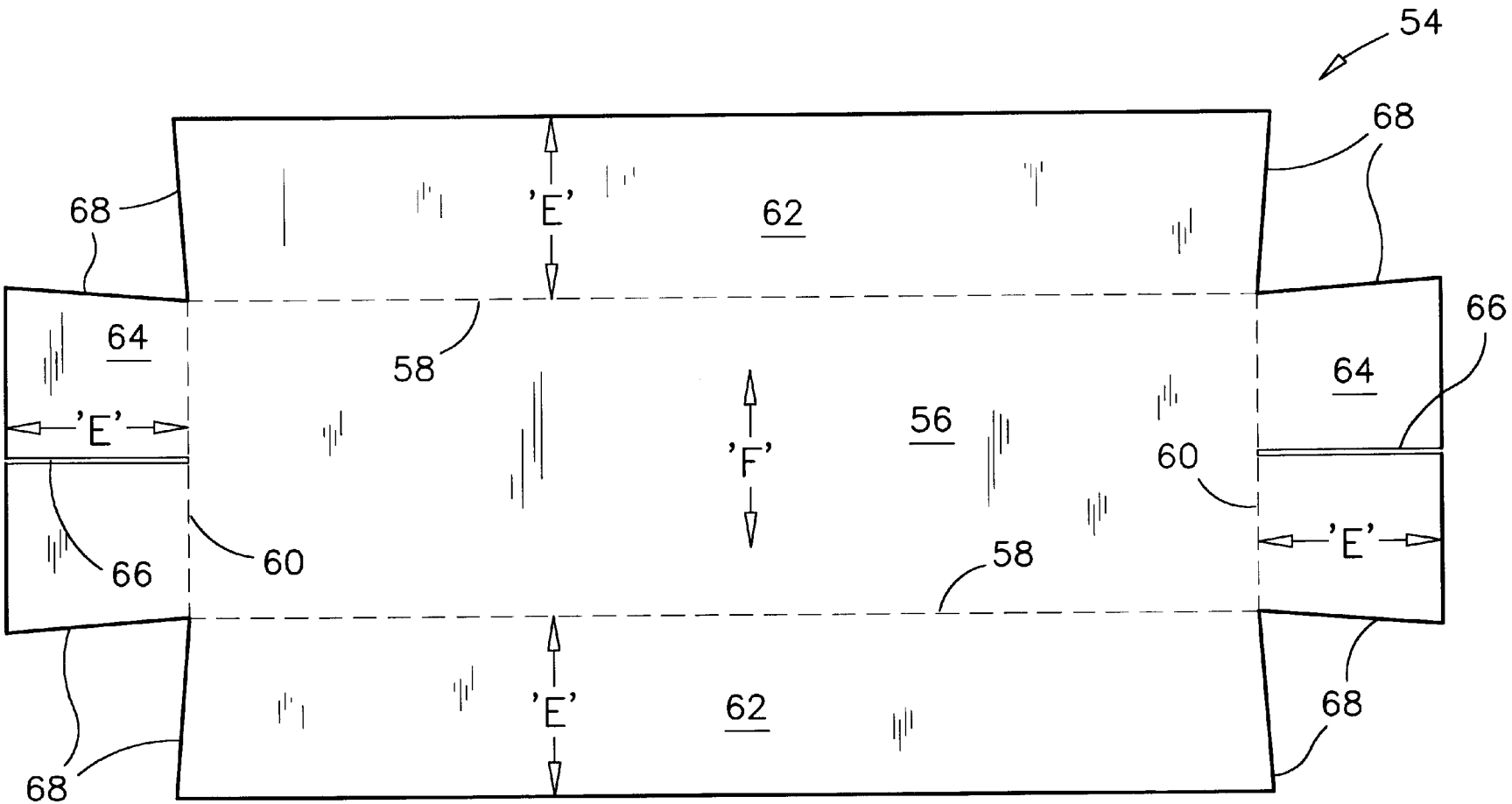
FIG. 3 is a flat pattern of an outer layer of corrugated paperboard used in the structure of the casket shell.

Referring to FIGS. 1–3, the casket shell 20 according to the preferred embodiment is made, basically, of an inner layer of corrugated paperboard 22, and outer layer of corrugated paperboard 24, a decorative fabric or paper cover 26, handles 28, a rim frame 30, and handle-backing boards 32.

The inner layer of corrugated paperboard 22 has three plies and the outer layer 24 has one ply. Both layers are glued to one another to form a laminated structure as will be explained later.

The inner layer of corrugated paperboard 22 is folded from a first planar scored blank 34 in which a bottom portion 36 has spaced-apart lengthwise creases 38 and spaced-apart widthwise creases 40 defining the inside length and width of the casket shell 20. Adjacent the lengthwise creases 38, the blank extends transversely a distance 'A' on each side thereof, thereby defining side members 42 of the casket shell. Adjacent he widthwise creases 40, the first blank extends longitudinally the distance 'A' at each end thereof, thereby defining end members 44 of the casket shell. Each end members 44 has a pair of flap member 46 each extending transversely on a respective side thereof. Each flap member 46 is foldable along a respective corner crease 48 which is, in the flat pattern, continuous with one of the lengthwise creases 38.

The length 'B' of each side member 42 is shorter than the length of the bottom portion 36 by a dimension which is equivalent to twice the width 'C' of a flap member 46, such that when the first blank 34 is folded, the outside edge 50 of a flap member 46 is aligned with, and abuts against, the vertical edge 52 of a side member 42. This configuration is advantageous for maintaining a uniform thickness of the inner liner 22 all around the casket shell. This configuration is also advantageous for providing maximum stiffness to the casket shell, as will be appreciated from the following disclosure.

The corrugation in the first blank 34 are aligned transversely relative to the casket shell, in a direction represented by arrow 'D'. Hence, when the first blank is folded, the corrugation in the side members 42 are aligned vertically, thereby providing for greater vertical tensile strength as compared to a longitudinal alignment. Similarly, the corrugation in the vertical corner creases 48 are aligned horizontally, or across the creases 48. This corrugation alignment provides for greater corner stiffness, and squareness retention ability as opposed to corrugation aligned along a crease.

The outside liner 24 of corrugated paperboard is made from a second planar scored blank 54. This second planar blank 54 has a bottom portion 56 defined by a pair of longitudinal creases 58 and a pair of transversal creases 60. The side portions 62 and end portions 64 extend from the longitudinal and transversal creases 58,60 respectively, a dimension 'E' defining the depth of the casket shell. In each end portion 64 there is provided a longitudinal slot 66 along a median thereof. These slots 66 are usable for inserting the covering material 26 and for simulating a sewn seam in the covering material. The dimension 'E' is longer that the width 'A' of the side members 42 and height of the end members 44, by a dimension corresponding to the depth of a rim frame 30. Thus when a rim frame 30 is a same thickness as the triple-ply inner liner 22 of corrugated paperboard, the outer liner 54 is usable for joining the rim frame 30 to the inner liner 22 in an abutting manner along the top edge of the inner liner 22 such that the shell structure 20 has an uniform thickness.

The corrugation in the second blank 54 are aligned transversely relative to the casket shell, as illustrated by label 'F', such that the vertical tensile strength of the side members 62 is maximum.

The length of each side portion 62 and the width of each end portion 64 are substantially the same as the length and width of the casket shell 20 such that when the second blank is folded, each vertical corner 70 of the casket shell is defined by a pair of adjoining straight-cut edges 68. Each vertical corner 70 of the casket shell is thereby a sharp straight-angled edge as illustrated in FIG. 6.

Moreover, and because the outer liner 22 of corrugated paperboard s a single ply material, the lower horizontal corners around the bottom of the casket shell also are sharp corners as compared to the paperboard caskets of the prior art made with multi-ply material.

Figure 6:
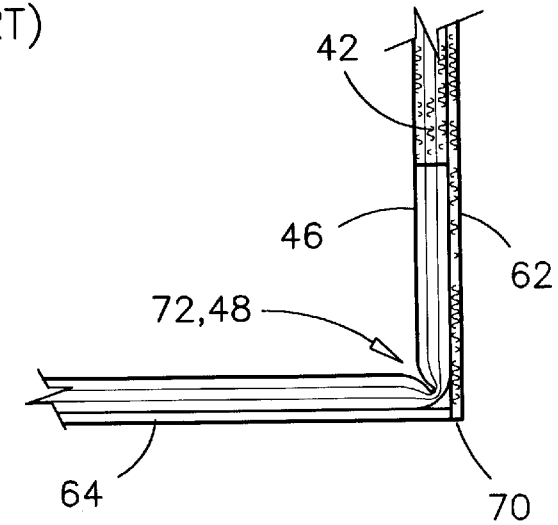
FIG. 6 is a cross-section view of a corner in the casket shell according to the preferred embodiment.
Figure 5:
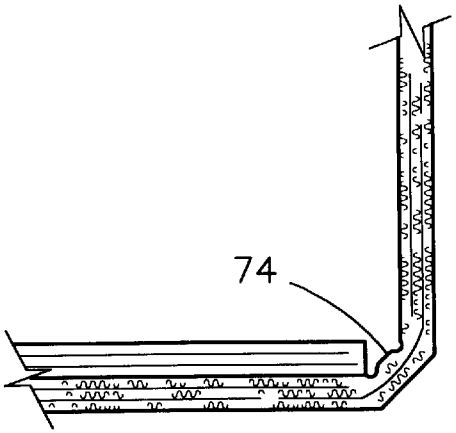
FIG. 5 (PRIOR ART)
FIG. 5 is a cross-section view of a typical corner in a casket shell of the prior art.

There is also illustrated in FIG. 6, a closeup cross-section view of a corner in the casket shell according to the preferred embodiment. The fold 72 along the crease 48 is made across the alignment of the corrugation in the triple-ply material of the first blank, as was explained earlier. This type of fold 72 is known to offer a better resistance against deformation than a fold made along the corrugation. For comparison purposes, there is illustrated in FIG. 5 a fold 74 made in a triple-ply paperboard material along the corrugation of a paperboard material. It will be appreciated that when this type of fold 74 is used on the corner of a casket shell, and that the casket shell is subjected to torsional stresses, the fold 74 has a tendency to roll out of shape relatively easily and to allow the casket shell to deform and convey an impression of flimsiness. This particularity is much less observable when a crease is formed across the alignment of the corrugation.

Figure 4:
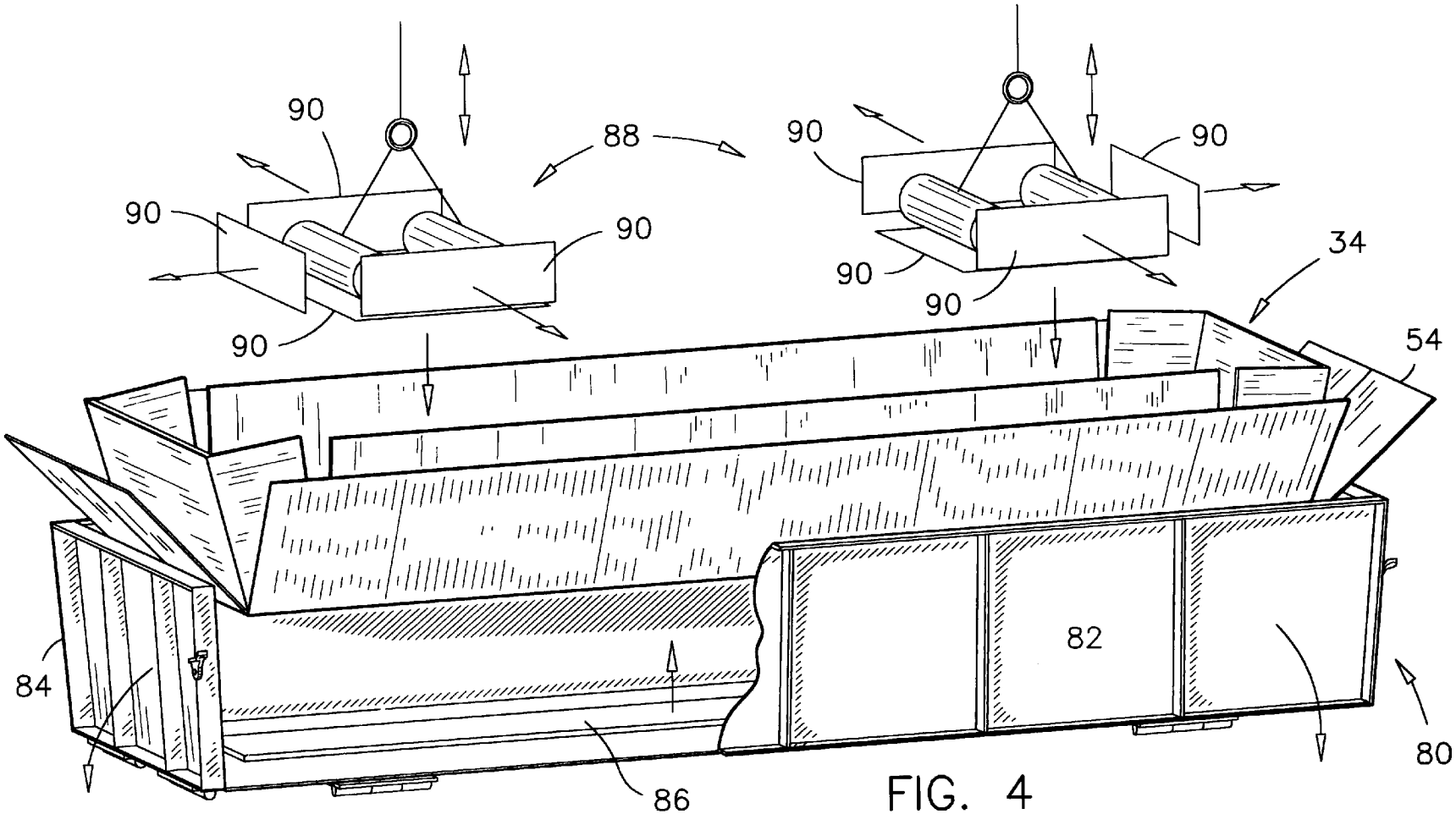
FIG. 4 is an illustration of the forming of the casket shell using a mold and pressure-applying devices.

Referring back to FIG. 4, the casket shell according to the preferred embodiment is manufactured by firstly spraying the inside face of the second blank 54 with glue; placing the first blank 34 over the glue-covered side of the second blank 54, and while manually folding both blanks, pushing the blanks inside a mold 80 having the shape of the casket shell to be formed.

The preferred mold 80 has at least one openable side 82 and at least one openable end 84, such that the formed casket-shell base may be taken out of the mold 80 with ease. The preferred mold 80 also has a longitudinal pusher plate 86 at the bottom thereof. The pusher plate 86 is movable in up and down directions by an actuator (not shown) for applying an upward pressure against the bottom of the second blank 54 and to cause at least a large central area of the second blank 54 to adhere to the first blank 34. Similarly a pair of pressure-applying devices 88 are movable inside the casket-shell base being manufactured for pushing the inner liner 22 against the outer liner 24 and cause a major surface of the inner liner to adhere to the outer liner. The pressure-applying devices 88 have pressure plates 90 that are movable longitudinally, transversely and downward relative to the casket-shell base 92 being manufactured. The mechanisms for operating the pressure plates 90 along three axes have not been illustrated herein for being devisable in many different ways that are common to those skilled in the art of machine design.

The reinforcing rim frame 30 and handle-backing boards 32 are also glued to the paperboard liners 22,24 while these liners are set inside the mold 80. For this purpose, the pressure-applying devices 88 preferably have fixtures (not shown) for readily positioning the handle-backing boards 32 inside the shell base.

Figure 7:
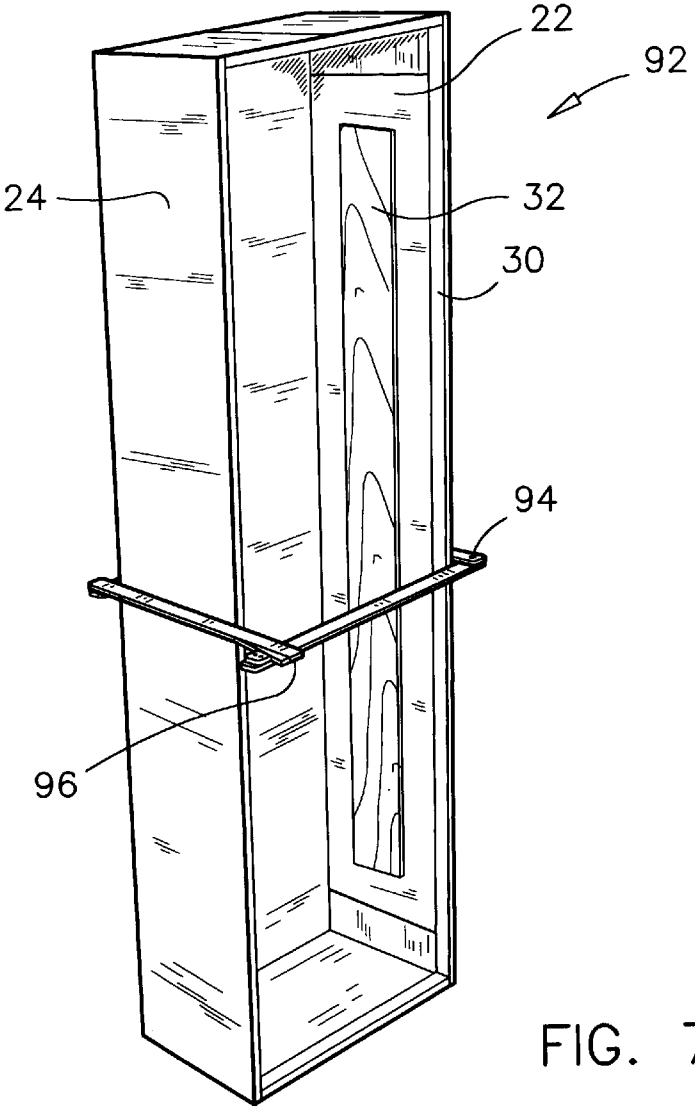
FIG. 7 is a perspective view of a casket-shell base according to the preferred embodiment during a manufacturing step.

Referring now FIG. 7, the illustration therein shows another important step in the manufacturing of a casket shell according to the preferred embodiment. The glued inner and outer liners 22,24 of the casket-shell base 92 are taken out of the mold 80 after the glue has started to set but while it is not completely cured. The removing of the shell base 92 from the mold 80 is preferably effected as soon as the liners retain their box-like shape.

The base 92 is then set upright right on its end, with a belt-like jig 94 encircling a middle region thereof. The belt-like jig 94, as illustrated in FIG. 7, has a wedge tightener 96 for forcing the side of the shell base 92 inwardly during an intermediate glue-setting stage. The wedge tightener 96 is calibrated to pre-stress the side of the shell base toward oneanother another a specific distance such that when the jig 94 is removed, the sides of the shell-base 92 retain a straight alignment for better imitating the straightness of a wood structure.

For reference purposes, a preferred adhesive is a polyvinyl acetate emulsion adhesive that is identified by the product number 46–70 LV and which is available from National Casein (Canada) Incorporated, of Tapscott Road, Scarborough, Ontario, Canada. When this adhesive is used in the manufacturing of the casket shell of the preferred embodiment, the shell base 92 is left inside the mold for about 3 minutes. It is taken out of the mold and set on its end with the belt-like jig 94 for about another 10 minutes. Then, the shell base 92 is set aside the production line for a final curing time of about two hours before the finishing material is affixed thereto.

It will be appreciated that this pre-stressing aspect of the casket shell according to the present invention is possible because of the laminated structure thereof, and the timing at which the pre-stressing of the side members with the belt-like jig 94 is effected and maintained.

As to the manner of attaching the finishing material, the handles, hinges and garniture, the same should be apparent from the above description, and accordingly, no further discussion relative to this aspect is provided.

While one embodiment of the present invention has been illustrated in the accompanying drawings and described herein above, it will be appreciated by those skilled in the art that various modifications, alternate constructions and equivalents may be employed without departing from the true spirit and scope of the invention. Therefore, the above description and the illustrations should not be construed as limiting the scope of the invention which is defined by the appended claims.

What is claimed is:

1. A casket shell having a bottom, sides and ends, and orthogonal length, width and depth dimensions and comprising:

an inner layer made of corrugated paperboard and comprising a bottom planar portion and side and end portions joining said bottom planar portion along lengthwise and widthwise creases formed therein relative to said dimensions;

each of said side portions having a longitudinal measure defined between a pair of spaced-apart transversal edges relative to said dimensions;

each of said end portions having a U-shaped configuration comprising a planar end member set substantially at right angle relative to said side portions, and two flap members each being connected to a respective side of said planar end member along a depth-wise crease relative to said dimensions, each of said flap members having a straight edge at a distance from said depth-wise crease, and each of said flap members extending toward one of said side portions in a planar relationship with said one of said side portions, with said straight edge contiguously abutting against one of said transversal edges of said side portions;

an outer layer made of paperboard material and having a bottom segment and planar side and planar end segments respectively overlapping said bottom portion and said side and end portions entirely, and being secure to said inner layer for joining said flap members to said side portions; and said inner layer having a first uniform thickness and said second layer having a second uniform thickness;

such that a total thickness thereof along said bottom, sides and ends being alike for better imitating a wood structure.

2. The casket shell as claimed in claim 1, wherein a corrugation in said side portions is oriented along said depth dimension, and a corrugation in said end members and in said flap members is oriented along said width and said length respectively.

3. The casket shell as claimed in claim 2, wherein said inner layer has three plies.

4. The casket shell as claimed in claim 3, wherein said outer layer is made of corrugated paperboard.

5. The casket shell as claimed in claim 4, wherein said outer layer has one ply.

6. The casket shell as claimed in claim 1, wherein each said end segment has a slot in a median area thereof along said depth dimension.

7. The casket shell as claimed in claim 6, further comprising a fabric cover over said outer layer, and said fabric cover has an edge tucked in said slot.

8. The casket as claimed on claim 1, further comprising a rim frame adjacent an edge of said side and end portions opposite said bottom portion, and said outer layer overlaps said rim frame.

9. The casket shell as claimed in claim 8, wherein said side portions and said side segments are pre-stressed toward one-another.

10. The casket shell as claimed in claim 9, further comprising wood boards affixed to said side portions, between said rim frame and said bottom portion.

11. The casket shell as claimed in claim 1, wherein said outer layer has straight-cut edges along said depth-wise creases.

12. A casket shell having a bottom, sides and ends, and orthogonal length, width and depth dimensions and comprising:

an inner layer made of triple-ply corrugated paperboard and comprising a bottom planar portion and side and end portions joining said bottom planar portion along lengthwise and widthwise creases formed therein relative to said dimensions;

each of said side portions having a longitudinal measure defined between a pair of spaced-apart transversal edges relative to said dimensions;

each of said end portions having a U-shaped configuration comprising a planar end member set substantially at right angle relative to said side portions, and two flap members each being connected to a respective side of said planar end member along a depth-wise crease relative to said dimensions, each of said flap members having a straight edge at a distance from said depth-wise crease, and each of said flap members extending toward one of said side portions in a planar relationship with said one of said side portions, with said straight edge contiguously abutting against one of said transversal edges of said side portions;

an outer layer made of paperboard material and having a bottom segment and planar side and planar end segments respectively overlapping said bottom portion and said side and end portions entirely, and being secure to said inner layer for joining said flap members to said side portions;

a rim frame adjacent an outside edge of said side and end portions opposite said bottom portion, and being overlapped by, and joined to said inner layer, by said outer layer; and wood boards affixed to said side portions, between said rim frame and said bottom portion;

said side portions, said side segments, and said wood boards being prestressed toward one-another in a straight alignment;

such that a total thickness thereof along said bottom, sides and ends being alike and said sides being durably straight for better imitating a wood structure.

13. The casket shell as claimed in claim 12, wherein said outer layer is made of single-ply corrugated paperboard, and a corrugation in said side portions is oriented along said depth dimension, and a corrugation in said end members and in said flap members is oriented along said width and said length respectively.

14. The casket shell as claimed in claim 12, wherein each said end segment has a slot in a median area thereof along said depth dimension, and said casket shell further comprises a fabric cover over said outer layer, and said fabric cover has an edge tucked in said slot.

15. The casket shell as claimed in claim 14, wherein said outer layer has straight-cut edges along said depth-wise creases.

* * * * *